US011525216B2

(12) United States Patent
Nagaoka

(10) Patent No.: US 11,525,216 B2
(45) Date of Patent: Dec. 13, 2022

(54) METHOD OF MANUFACTURING CELLULOSE NANOFIBER COMPACT

(71) Applicant: HOSIDEN CORPORATION, Osaka (JP)

(72) Inventor: Satofumi Nagaoka, Osaka (JP)

(73) Assignee: Hosiden Corporation, Osaka (JP)

( * ) Notice: Subject to any disclaimer, the term of this patent is extended or adjusted under 35 U.S.C. 154(b) by 233 days.

(21) Appl. No.: 16/941,660

(22) Filed: Jul. 29, 2020

(65) Prior Publication Data

US 2021/0032816 A1 Feb. 4, 2021

(30) Foreign Application Priority Data

Aug. 2, 2019 (JP) ..... JP2019-142746

(51) Int. Cl.
*D21H 15/10* (2006.01)
*D21H 11/18* (2006.01)

(52) U.S. Cl.
CPC ..... *D21H 15/10* (2013.01); *D21H 11/18* (2013.01)

(58) Field of Classification Search
CPC ..... D21H 15/10; D21H 11/18; D21H 11/16; D21J 3/00
See application file for complete search history.

(56) References Cited

U.S. PATENT DOCUMENTS

2017/0314201 A1 11/2017 Hikida

FOREIGN PATENT DOCUMENTS

| | | | |
|---|---|---|---|
| JP | 2016-94683 A | | 5/2016 |
| JP | 2018-59236 A | | 4/2018 |
| JP | 2018-062718 A | | 4/2018 |
| JP | 2018062718 A | * | 4/2018 |
| WO | 2015/068818 A1 | | 5/2015 |

OTHER PUBLICATIONS

European Search Report dated Oct. 16, 2020.

* cited by examiner

*Primary Examiner* — Eric Hug
*Assistant Examiner* — Matthew M Eslami
(74) *Attorney, Agent, or Firm* — Dilworth & Barrese, LLP

(57) ABSTRACT

A method of manufacturing a cellulose nanofiber compact includes a supporting step of supporting a plate-like first precursor containing cellulose nanofibers in a heating vessel, a preliminary molding step of heating the first precursor supported in the heating vessel with infrared rays to obtain a plate-like second precursor and a molding step of molding the second precursor, with heating and pressurizing the second precursor in a mold.

20 Claims, 4 Drawing Sheets

METHOD OF MANUFACTURING CELLULOSE NANOFIBER COMPACT

CROSS REFERENCE TO RELATED APPLICATION

This application is based on and claims priority under 35 U.S.C. Section 119 to Japanese Patent Application No. 2019-142746 filed on Aug. 2, 2019, the entire contents of which are incorporated herein by reference.

TECHNICAL FIELD

This disclosure relates to a method of manufacturing a cellulose nanofiber compact.

BACKGROUND

Nano fibers can be obtained generally by pulverizing pulp or the like under a water-dispersed state thereof. Therefore, in obtaining a compact (i.e. a molded product) of cellulose nanofibers (CNF) from slurry (water dispersion) of the cellulose nanofibers, the slurry needs to be dehydrated and molded (see e.g. Japanese Unexamined Patent Application No. 2018-059236, Japanese Unexamined Patent Application No. 2016-094683).

JP No. 2018-059236 discloses a method of manufacturing a cellulose nanofiber compact. This method includes a step of dehydrating slurry containing cellulose nanofibers through a mesh-like member. At this dehydrating step, a pressurizing force applied to the slurry is increased either stepwise or continuously. When the slurry of cellulose nanofibers is dehydrated through such mechanical pressurization, outflow of CNF (cellulose nanofibers) together with water can sometimes occur. However, with the above-described method, dehydration can be carried out efficiently with suppression of outflow of CNF.

JP No. 2016-094683 discloses a method of molding cellulose nanofibers as well as a CNF compact obtained by the molding method. In this method, into a mold formed by overlapping a porous body formed of such material as ceramics, resin, or the like and a rectangular stainless frame having one side open, cellulose nanofiber containing slurry is charged and then another porous body is placed on this cellulose nanofiber containing slurry. In this, by wrapping the cellulose nanofiber containing slurry by a mesh or a membrane, leak from a gap between the mold and the porous body and clogging of the porous body can be suppressed.

SUMMARY

Cellulose nanofibers are a material capable of forming a compact (molded product) having high strength by firm bonding thereof through mutual physical intertwining or hydrogen bond. However, with the methods disclosed in JP No. 2018-059236 and JP No. 2016-094683, it has been sometimes not possible to obtain a cellulose nanofiber compact having sufficient strength.

In an embodiment of this disclosure, there is disclosed a manufacturing method that can realize a cellulose nanofiber compact having high strength.

According to one embodiment of an inventive method of manufacturing a cellulose nanofiber compact relating to this disclosure, the method comprises:

a supporting step of supporting a plate-like first precursor containing cellulose nanofibers in a heating vessel;

a preliminary molding step of heating the first precursor supported in the heating vessel with infrared rays to obtain a plate-like second precursor; and a molding step of molding the second precursor, with heating and pressurizing the second precursor in a mold.

With the above-described embodiment, at the supporting step, by supporting a plate-like (in the form of a membrane having a certain thickness) first precursor in a heating vessel, it is possible to keep the shape of the first precursor in the course of heating. Incidentally, in the above-described embodiment, the second precursor is a precursor of a compact of cellulose nanofibers (may be referred to as CNF hereinafter) (a molded product, which may be referred to simply as a "compact" hereinafter) obtained by the molding step. And, the first precursor is a precursor of the second precursor.

With the above-described embodiment, at the preliminary molding step, heating of the first precursor supported in the heating vessel is implemented by irradiation of infrared rays (in particular, far infrared rays). As the infrared rays are irradiated on the first precursor, the molecules of CNF are applied with energy in the infrared range, so that vibration of chemical bond (in particular, the hydroxy group) occurs. With this vibration, e.g. side chains of the CNF molecules come closer to each other, thus promoting hydrogen bond among the CNF molecules. Namely, by heating the first precursor with infrared rays, there can be obtained a second precursor with the hydrogen bond promoted. As a result, the strength of the compact (e.g. its tensile modulus of elasticity or bending modulus of elasticity) is improved. Incidentally, at the preliminary molding step, the purpose of heating is to promote the hydrogen bond, whereas progress of drying is not absolutely needed.

According to one embodiment of a method of manufacturing a cellulose nanofiber compact relating to this disclosure:

the heating vessel is formed of ceramics; and at the preliminary heating step, the first precursor is heated by infrared rays radiated from the heating vessel.

With the above-described embodiment, the heating vessel is formed of ceramics. For instance, when a heating vessel formed of ceramics is heated by an electric heater or the like, infrared rays (in particular, far infrared rays) are radiated from the ceramics and these radiated infrared rays are irradiated to the first precursor. Namely, by using a heating vessel formed of ceramics, both supporting of the first precursor and heating thereof with infrared rays can be realized.

According to one embodiment of a method of manufacturing a cellulose nanofiber compact relating to this disclosure:

the heating vessel is constituted of a porous body defining therein many pores that allow passage of water vapor; and at the preliminary heating step, water contained in the first precursor is released through pores of the heating vessel to the outside.

With the above-described embodiment, the heating vessel is constituted of a porous body defining many pores. At the preliminary molding step, the first precursor is heated, so that water will be evaporated from the first precursor. In this, as the heating vessel is provided as a porous body, water content (water vapor) evaporated from the face of the first precursor facing the heating vessel can be passed through the pores of the heating vessel to be released to the outside. With this, it is possible to avoid occurrence such as condensation of evaporated water content on the surface of the first precursor or stagnant retention of water vapor at the interface between the heating vessel and the first precursor, both of which can lead to quality deterioration of the compact obtained.

According to one embodiment of a method of manufacturing a cellulose nanofiber compact relating to this disclosure:

at the supporting step, the first precursor is supported with cellophane being interposed between the first precursor and the heating vessel.

With the above-described embodiment, since cellophane allows permeation of water vapor therethrough, in the course of heating at the preliminary molding step, the water vapor generated from the first precursor can be released to the outside. Further, with the above-described arrangement, it is possible to transfer the first precursor to the mold, with the first precursor being held by the cellophane. Incidentally, according to the above embodiment, in case the heating vessel is constituted of a porous body, it is possible to prevent the first precursor from flowing into the pores of the heating vessel, so that clogging of the heating vessel as a porous body can be prevented.

According to one embodiment of a method of manufacturing a cellulose nanofiber compact relating to this disclosure:

the mold includes a first mold and a second mold disposed in opposition to the first mold;

the second precursor is mounted and pressurized between the first mold and the second mold; and a surface of the second mold in contact with the second precursor is covered by a mesh-like member.

With the above-described embodiment, it is possible to keep the shape of the second precursor charged within the mold (between the first mold and the second mold), so that a compact having a desired shape can be obtained. Namely, as the second precursor is held by a frictional force applied from the mesh of the mesh-like member, displacement of a portion of the second precursor (collapsing) is prevented. Thus, it is possible to avoid occurrence such as thinning or breaking of a portion of the second precursor. As a result, a compact having a desired shape can be obtained.

According to one embodiment of a method of manufacturing a cellulose nanofiber compact relating to this disclosure:

the method further comprises, prior to the supporting step, a condensing step of condensing the cellulose nanofiber containing slurry by microwave heating to obtain the first precursor; and the condensing step includes a charging step of charging the cellulose nanofiber containing slurry into a bottomed cylindrical condensing vessel and a covering step of covering a center portion of the surface of the cellulose nanofiber containing slurry within the condensing vessel with a lid member.

With the above-described embodiment, the cellulose nanofiber containing slurry having a higher water content than the first precursor is condensed by microwave heating to evaporate the water in the slurry, whereby the first precursor can be obtained. The condensation of the cellulose nanofiber containing slurry is done by charging the cellulose nanofiber containing slurry into a bottomed cylindrical condensing vessel, and irradiating microwave to the cellulose nanofiber containing slurry reserved (charged) in the condensing vessel by means of e.g. a microwave heater or the like (microwave heating). In the case of heating by heat transfer, in comparison with the inner side of the slurry, the portion of the slurry located near the wall surface of the heat transferring vessel tends to be heated more easily. For this reason, if it is attempted to increase the drying rate by heating by heat transfer, the slurry adjacent the heating vessel will be dried at an excessive rate, thus tending to invite local excess drying. Thus, there could occur the inconvenience that before the reinforcement of CNF by the hydrogen bond, a paper-like structure may be formed to cause reduction in the strength of the resultant compact. In contrast, with the microwave heating, it is possible to heat the entire slurry within the vessel. Therefore, the drying rate can be increased without causing excessive local drying and the period required for condensing can be shortened (production efficiency can be improved).

Further, with the above-described embodiment, in the course of the microwave heating, the center portion of the cellulose nanofiber containing slurry is covered with a lid member. With this, drying at an excessive rate can be avoided at the center portion the cellulose nanofiber containing slurry which portion tends to be more readily influenced by microwave irradiation by a microwave heater device or the like and drying tends to progress more positively than the portion of the reserved cellulose nanofiber containing slurry located near the lateral wall of the condensing vessel (i.e. the outer circumferential portion of the reserved cellulose nanofiber containing slurry), whereby uniformity of drying rate between the center portion and the outer circumferential portion can be achieved. Consequently, it is possible to avoid the above-described inconvenience that excessive local drying occurs at an excessive rate at the center portion and resultantly a paper-like structure is formed before reinforcement of CNF is provided by hydrogen bond, thus inviting reduction in the strength of the resultant compact.

According to one embodiment of a method of manufacturing a cellulose nanofiber compact relating to this disclosure:

the preliminary molding step includes an aging step of promoting the hydrogen bond between the nanocellulose fibers in the second precursor, with keeping the surface temperature of the heating vessel between equal to or higher than 50° C. and equal to or lower than 120° C.

With the above-described embodiment, the temperature of the first precursor at the preliminary molding step can be maintained between equal to or higher than 50° C. and equal to or lower than 120° C. With this, it is possible to avoid drying of the first precursor before the progress of hydrogen bond, so that the hydrogen bond between the CNF molecules can be promoted while allowing the movements of the CNF molecules as well as vibration and movements of their side chains. Incidentally, if the drying progressed at an excessive rate at the preliminary molding step just like the condensing step, there could occur the inconvenience of the CNF in the first precursor forming a paper-like structure, thus leading to reduction in the strength of the compact.

DESCRIPTION OF EMBODIMENTS

[Overview of Manufacturing Method]

A method of manufacturing a cellulose nanofiber compact according to this embodiment includes and carries out: a condensing step of condensing cellulose nanofiber containing slurry by microwave heating to obtain a first precursor; a supporting step of supporting a plate-like first precursor containing cellulose nanofibers on a surface of a heating vessel; a preliminary molding step of heating the first precursor supported in the heating vessel with infrared rays to obtain a plate-like second precursor; and a molding step of molding the second precursor with heating and pressurizing the second precursor in a mold, one after another in the mentioned order, thus realizing a cellulose nanofiber compact having high strength (e.g. tensile elasticity modulus or bending elasticity modulus).

The cellulose nanofibers (maybe referred to as "CNF" hereinafter) in this embodiment refer to fine cellulose fibers, which may have a fiber width (diameter of fiber, to be referred to as fiber diameter hereinafter) equal to or greater than 1 nm and equal to or less than 150 nm or less, a fiber length equal to or greater than 3 nm and less than 300 μm, for instance. An average fiber length of CNF can be determined by e.g. image analysis using a scanning electron microscope (SEM). An average fiber diameter of CNF can also be determined by image analysis using a scanning electron microscope (SEM), like the fiber length described above. As the CNF, it is possible to employ one obtained by disentanglement or breaking up of plant material such as pulp (pulp fibers).

With the cellulose nanofiber containing slurry (CNF containing slurry) used in this embodiment, its CNF content preferably ranges equal to or greater than 0.5 mass % and less than 10 mass %, especially preferably, equal to or greater than 2 mass % and less than 6 mass %.

In the following, with reference to the accompanying drawings, the manufacturing method of the cellulose nanofiber compact (to the referred to simply as "compact" hereinafter) will be explained by citing specific examples thereof.

[Condensing Step]

Figure 1:
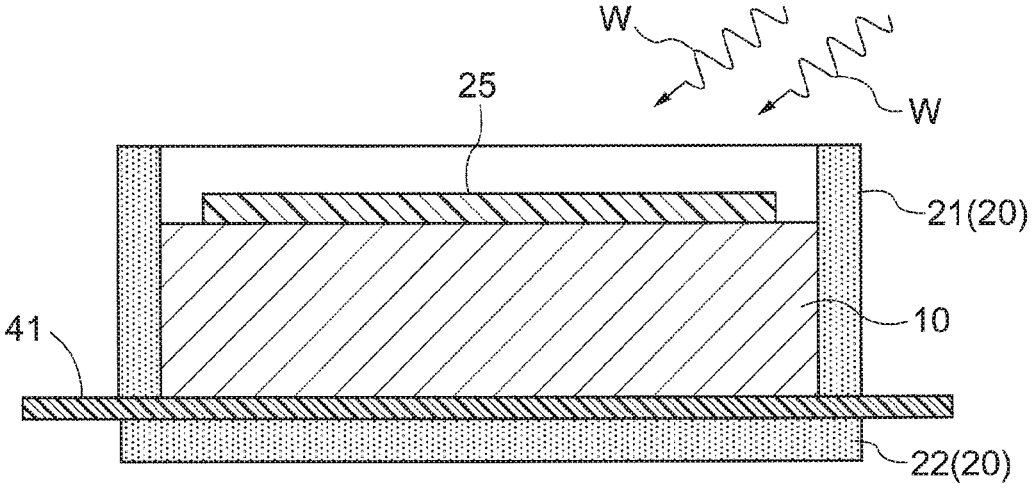
FIG. 1 is a schematic section showing the inside of a condensing vessel in order to explain a condensing step.
Figure 2:
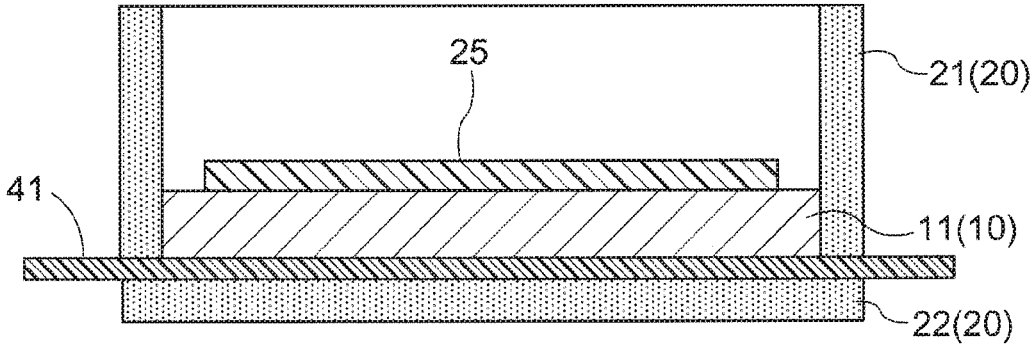
FIG. 2 is a schematic section showing the inside of the condensing vessel for explaining a state at the time of completion of the condensing step.

At the condensing step, as shown in FIG. 1, the CNF containing slurry (e.g. water dispersion containing 3 mass % of CNF, to be referred to simply as "slurry 10" hereinafter) is subjected to irradiation of microwave (e.g. having a frequency of 2.45 GHz) to be heated, so that the slurry 10 is condensed to obtain a first precursor 11 (see FIG. 2). At this condensing step, as will be described later, a charging step, a covering step, an MW irradiating step and a stabilizing step are carried out.

At the condensing step, there are used a bottomed cylindrical condensing vessel 20, water-permeable membranes 41, 42 and a plate-like lid member 25.

The condensing vessel 20 includes a tubular portion 21 which can be cylindrical and a bottom plate 22 as a member separate from the tubular portion 21. The bottom plate 22 is a plate formed of porous ceramics. The bottom plate 22, due to its porosity, allows permeation of water vapor through its plate face. In this embodiment, the tubular portion 21 is a tube formed of porous ceramics, as is the case with the bottom plate 22. The diameter of the tube of the tubular portion 21 is e.g. 5 cm.

The water-permeable membranes 41, 42 are membrane materials that allow permeation of water or water vapor therethrough. These water-permeable membranes 41, 42 are thin membranes based on cellulose (a film formed of cellulose, so-called cellophane). The thickness of the water-permeable membranes 41, 42 is e.g. about 30 μm (300 g/m$^2$) for instance, in the case of cellophane.

The lid member 25 has a diameter slightly smaller than the inside diameter of the tubular portion 21 (e.g. about 80%) and comprises a plate formed of polyimide (e.g. having a thickness of 1.5 mm). The plate face of this lid member 25 is not permeable to water vapor.

At the condensing step, as shown in FIG. 1, the water-permeable membrane 41 is placed to cover the bottom plate 22. Then, the tubular portion 21 is placed on this water-permeable membrane 41. In this placing, in this embodiment, the water-permeable membrane 41 is bound between the entire circumference of the bottom face of the tubular member 21 and the upper face of the bottom plate 22.

Next, into a condensing vessel 20 (onto the water-permeable membrane 41), a measured predetermined amount (e.g. 15 g) of slurry 10 is charged by e.g. flowing (one example of the "charging step"). With this, the slurry 10 will be spread over the water-permeable membrane 41 inside the condensing vessel 20 and formed into a film or membrane having a certain thickness (e.g. thickness from 3 mm to 5 mm). Incidentally, the CNF content of the slurry 10 is e.g. 3 mass %.

After spreading of the slurry 10 on the water-permeable membrane 41, the surface of the slurry 10 is covered by the lid member 25. In this covering, the lid member 25 will be placed at the center portion in the upper face (surface) of the slurry 10, namely, at a position spaced apart from the entire inner circumference of the tubular portion 21 (the above represents one example of the "covering step").

Thereafter, with the surface of the slurry 10 being covered by the lid member 25, the slurry 10 will be subjected to heating by irradiation of microwave W thereto, by e.g. placing the condensing vessel 20 as a whole into a chamber of an electron microwave oven for industrial use (a microwave heater device, not shown) (this will be referred to as an "MW irradiating step" hereinafter). With this microwave heating, water will be evaporated from the slurry 10 and the slurry 10 will be condensed, thereby to obtain a first precursor 11 (see FIG. 2). Incidentally, FIGS. 1 and 2 show the dimensions and ratios with some deformation provided thereto for the sake of explanation of the embodiment, showing e.g. the thicknesses of the slurry 10, the first precursor 11 and the water-permeable membrane 41, etc. greater than their actual dimensions and ratios. This applies also to the illustrations of FIG. 3 and the drawings subsequent thereto.

As the upper surface center portion of the slurry 10 is covered with the lid member 25, it is possible to render uniform the degree of dryness between the center portion and the outer circumferential portion. The center portion of the slurry 10 is more susceptible to the irradiation of the microwave W inside the electron microwave oven, so that the drying there tends to progress more easily than the portion adjacent the lateral wall of the condensing vessel 20. For this reason, by covering this with the lid member 25, progress of drying at an excessive rate at the center portion (i.e. local excessive drying) and insufficient drying such as cracking associated therewith can be prevented. Further, with this prevention of local excessive drying, it is possible to prevent the inconvenience of forming of a paper-like structure prior to occurrence of reinforcement of CNF with the hydrogen bond, thus resulting in reduction in the strength of the compact.

A part of the water (water vapor) evaporated from the slurry 10 will be leaked to the outside from the portion of the upper surface of the slurry 10 not covered by the lid member 25. Another part of the water evaporated from the slurry 10 will permeate the water-permeable membrane 41 and further permeate the bottom plate 22 provided as a porous ceramic plate to be eventually leaked to the outside. As the water-permeable membrane 41 is interposed between the slurry 10 and the bottom plate 22, when the water evaporated from the slurry 10 permeates the bottom plate 22 to be leaked to the outside, it is possible to prevent CNF from intruding the pores of the bottom plate 22, thus causing clogging thereof.

At the MW (microwave) irradiating step, about a half of the water contained in the slurry 10 will be evaporated. For this MW irradiating step, preferably, the irradiation is carried out for a total time of from 4 minutes to 8 minutes approximately, with a power of 200 W per 15 g of the slurry 10, for instance. In this embodiment, there is explained an example in which the microwave W is irradiated for 6 minutes. With the irradiation of the microwave W, e.g. about 7.5 g of first precursor 11 (see FIG. 2) can be obtained. In case the irradiation is carried out with power greater than 200 W, the irradiation period should be reduced substantially in inverse proportion to this power. If the microwave W were irradiated (heated) for too long period, this would cause the formation of a paper-like structure inside the first precursor 11 prior to reinforcement of the CNF by the hydrogen bond, which can lead to reduction in the strength of a compact 13 (an example of a compact or molded product of the cellulose nanofibers, see FIG. 8). The irradiation period of the microwave W should be adjusted such that the mass of the resultant first precursor 11 (see FIG. 2) may range from 45% to 55% relative to the slurry 10.

At the MW irradiation step, it is also possible to vertically invert (turn upside down) the slurry 10 by a predetermined time interval within the condensing vessel 20. For instance, firstly, the microwave W is irradiated for 2 minutes and the slurry 10 is inverted. Then, the microwave W is irradiated for another 2 minutes and the slurry 10 is inverted. Then, the microwave W is irradiated again for 1 minute and the slurry 10 is inverted. Lastly, the microwave W is irradiated for 1 minute, thereby to complete the MW irradiating step to obtain the first precursor 11 (see FIG. 2). The first precursor 11 will be molded into the form of a soft gel in a plate shape (disc shape) whose outer circumferential shape complies with the shape of the inner circumference of the cylinder of the tubular portion 21.

Advantageously, after the MW irradiating step described above, the first precursor 11 may be left still for a predetermined period (e.g. 5 minutes) (this will be referred to as a "stabilizing step" hereinafter). With this stabilizing step, as the first precursor 11 is left still, irregularity of water contents of the respective portions within the first precursor 11 (e.g. between the upper and lower portion, between the center portion and the outer circumferential portion, etc.) is reduced, thus being rendered uniform.

Figure 3:
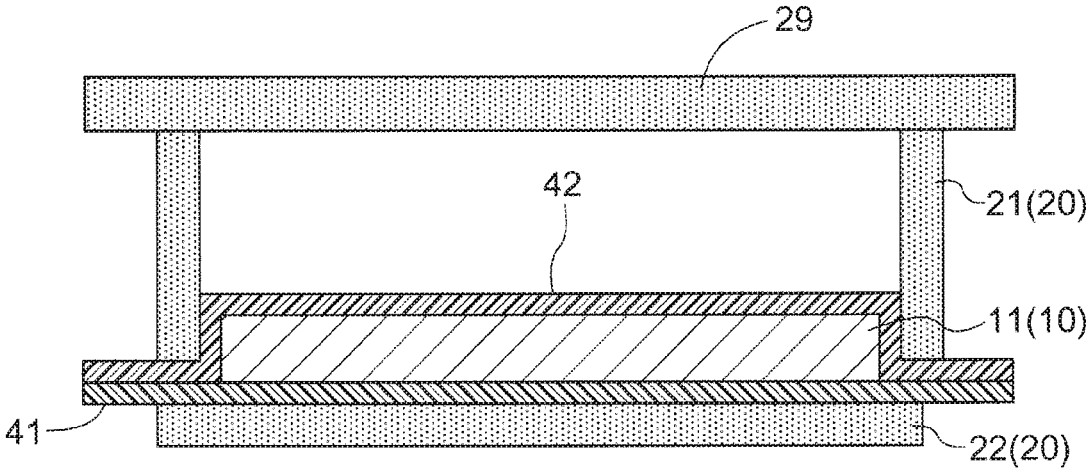
FIG. 3 is a schematic section showing the inside of the condensing vessel for explaining a stabilizing step.

At the stabilizing step, as shown in FIG. 3, the first precursor 11 is covered by the water-permeable membrane 42, whereby the first precursor 11 is bound and wrapped between/by the two water-permeable membranes 41, 42. This makes evaporation of water from the first precursor 11 difficult, so that the irregularity of water contents in the first precursor 11 at the stabilizing step is further reduced, thus being made even more uniform.

At the stabilizing step, as shown in FIG. 3, advantageously, the condensing vessel 20 may be closed with a vessel lid 29. The vessel lid 29 isolates the inside of the condensing vessel 20 from the outside, thus preventing changing of air. As a result, progress of drying of the first precursor 11 left within the condensing vessel 20 is suspended temporarily, thereby to further reduce irregularity of water content in the first precursor 11 at the stabilizing step, thus rendering it even more uniform. In the instant embodiment, as the vessel lid 29, there is employed a porous ceramic plate. With this, the humidity inside the condensing vessel 20 is kept high and at the same time, it is possible to avoid such inconvenience as occurrence of condensation on the inner face of the vessel lid 29 and/or the condensing vessel 20 and returning of condensed water to the first precursor 11, causing water content irregularity in the first precursor 11.

[Supporting Step]

Figure 4:
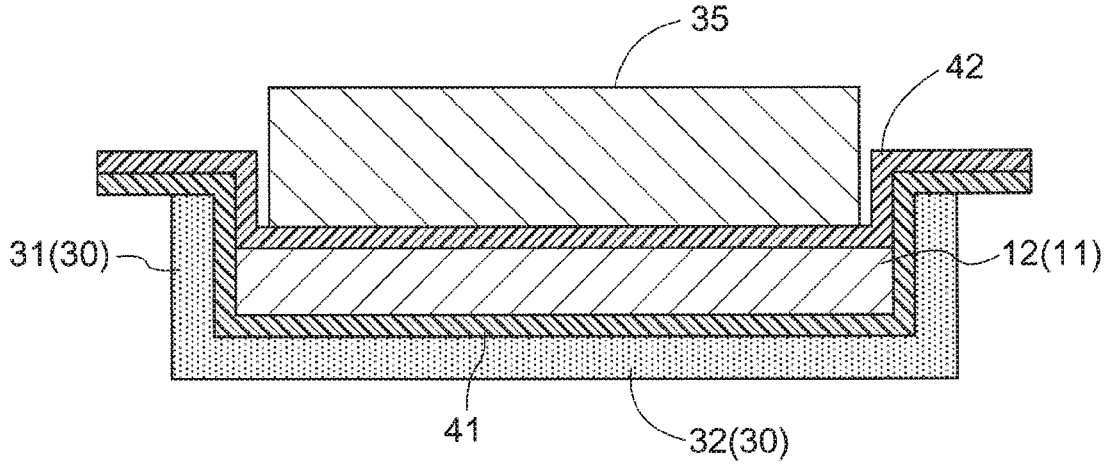
FIG. 4 is a schematic section showing the inside of a heating vessel for explaining a supporting step.

At the supporting step, as shown in FIG. 4, the first precursor 11 is transferred into a heating vessel 30. This heating vessel 30 is a bottomed cylindrical (dish-like) vessel including e.g. a cylindrical body portion 31 having a low profile with its one end closed to form a bottom portion 32. The heating vessel 30 is formed of porous ceramics (e.g. alumina ceramics, an example of "porous body"). Due to its porosity, the heating vessel 30 allows permeation therethrough of water vapor from the body portion 31 and/or the bottom portion 32. The diameter of the body portion 31 of the heating vessel 30 may be 4.9 cm, for example.

At the supporting step, the first precursor 11 will be removed from the condensing vessel 20 and then placed (an example of "supporting") onto bottom portion 32 in the inner side area of the cylinder of the heating vessel 30. In this, when the first precursor 11 is to be removed from the condensing vessel 20, the first precursor 11 as being kept wrapped by the water-permeable membranes 41, 42 will be removed together with these water-permeable membranes 41, 42. And, the first precursor 11, together with the water-permeable membranes 41, 42, will be placed on the bottom portion 22, with a positional relation of either one of the water-permeable membrane 41 and the water-permeable membrane 42 being in placed in contact with the bottom portion 32. In the course of this, advantageously, the first precursor 11 and the water-permeable membranes 41, 42 should be placed onto the bottom portion 32, without forming any wrinkles in these water-permeable membranes 41, 42. Incidentally, FIG. 4 shows an exemplary case in which the water-permeable membrane 41 is placed in contact with the bottom portion 32.

After the first precursor 11 is placed on the bottom portion 32, on this first precursor 11, a weight member 35 will be placed. Incidentally, this weight member 35 is a heavy object formed of a metal such as stainless steel and is also a cylindrical member having a diameter which is slightly smaller than the inside diameter of the heating vessel 30 (about 80% thereof). In the exemplary case shown in FIG. 4, the weight member 35 is placed on the water-permeable membrane 42. As the weight member 35 is placed on the first precursor 11, the first precursor 11 is pressed against the bottom portion 32, so that formation of wrinkles in the first precursor 11 can be prevented.

[Preliminary Molding Step]

Figure 5:
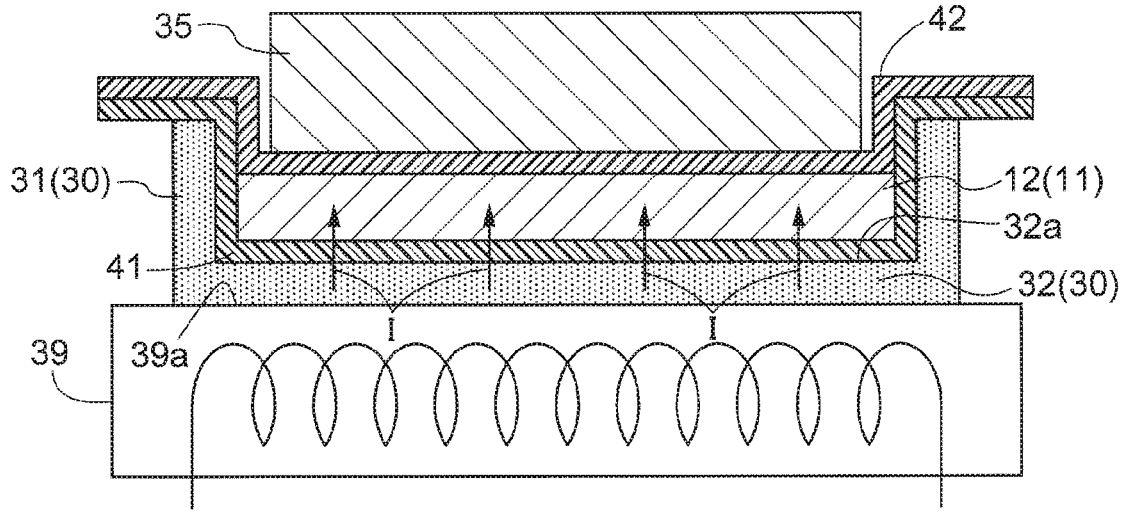
FIG. 5 is a schematic for explaining a preliminary molding step.

At the preliminary molding step, as shown in FIG. 5, there are carried out an IR irradiating step (an example of an "aging step") at which within the heating vessel 30, infrared rays I (an example of infrared radiation) are irradiated to the first precursor 11 for a predetermined period, thereby to promote hydrogen bond between the CNF's and to obtain a second precursor 12 and a removing step at which the water-permeable membranes 41, 42 are removed from the second precursor 12.

At the IR irradiating step, as the bottom portion 32 of the heating vessel 30 formed of ceramics is heated by a heater device 39 having a heating member such as an electric heating coil or the like, far infrared rays I are radiated from the heating vessel 30 (bottom portion 32), and these far infrared rays I are irradiated onto the first precursor 11.

At the IR irradiating step, with the irradiation of the far infrared rays I to the first precursor 11, energy in the infrared range is provided to the molecules of CNF, thus causing vibration in the chemical bond (in particular, the hydroxy group). With this vibration, e.g. mutual approaching of the side chains of the molecules of the CNF, and the hydrogen bond between the CNF molecules is promoted. Namely, by heating the first precursor 11 by the far infrared rays I, it is possible to obtain the second precursor 12 having the hydrogen bond promoted. As a result, the strength of the compact 13 to be described later (see FIG. 8) is enhanced.

Heating of the heating vessel 30 may be done by starting electric power supply to the heating coil of the heater device 39 after this heating vessel 30 is placed on the heat conductive face 39*a* of the heater device 39. Alternatively, on a heat transferring face 39*a* of the heater device 39 which has been provided with electric power supply for heating, the heating vessel 30 may be placed. In this embodiment, there will be described an exemplary case in which on the heat transferring face 39*a* of the heater device 39 which has been heated in advance to about 100° C. with electric power supply thereto, the heating vessel 30 after completion of the above-described supporting step (see FIG. 4) is placed for starting heating of the heating vessel 30.

Preferably, the irradiation of the far infrared rays I onto the first precursor 11 (heating of the heating vessel 30 by the heater device 39) is done, with setting the temperature (an example of the "surface temperature") of a heat receiving face 32*a* (an example of a "surface of the heater device") of the heating vessel bottom portion 32 placed in contact with the heat transferring face 39*a* of the heater device 39 for enabling heat transfer therewith to a temperature equal to or higher than 50° C. and equal to or lower than 120° C. In this embodiment, there will be explained an exemplary case of setting the temperature to 100° C. If the temperature of the heat receiving face 32*a* is higher than 120° C., there may occur an inconvenience that the first precursor 11 will be heated and dried by heat transferred from the bottom portion 32 before the CNF is reinforced by the hydrogen bond, so a paper-like structure will be formed therein to invite reduction of the strength of the compact 13. Conversely, if the temperature of the heat receiving face 32*a* is lower than 50° C., the far infrared rays I radiated from the heating vessel 30 will become weak, so that the hydrogen bond between the CNF's may not be promoted sufficiently.

At the IR irradiating step, promotion of drying of the first precursor 11 is not absolutely needed. It will suffice if the vibration of the chemical bond of CNF can be promoted by irradiation of the far infrared rays I for promotion of hydrogen bond, by keeping the temperature of the first precursor 11 within a predetermined range (a temperature slightly lower than the temperature of the heat receiving face 32*a* of the heating vessel 32, e.g. from 45° C. to 115° C.). Namely, if the temperature of the heat receiving face 32*a* is lower than 50° C., due to reduction in the molecular motion of CNF, vibration of the chemical bond of CNF will be suppressed, so that the hydrogen bond will not be promoted, disadvantageously. On the other hand, if the temperature of the heat receiving face 32*a* is higher than 120° C., due to resultant reduction in the water content of the first precursor 11, drying thereof will occur before the hydrogen bond can progress, so the paper-like structure will be formed, disadvantageously.

The period of irradiation of the far infrared rays I onto the first precursor 11 (the heating period of heating the heating vessel 30 by the heater device 39) ranges preferably from 5 minutes to 15 minutes. In this embodiment, there will be described an exemplary case of 10 minutes irradiation. The irradiation period may be shorter in case the temperature of the heat receiving face 32*a* of the heating vessel 32 is higher, and may be longer in case the temperature of the heat receiving face 32*a* of the heating vessel 32 is lower. For instance, in case the temperature of the heat receiving face 32*a* is 120° C., the irradiation period will be set to 6 minutes. For instance, if the temperature of the heat receiving face 32*a* is 50° C., the irradiation period will be set to 15 minutes.

At the IR irradiating step, the first precursor 11 is heated by the heat transfer and the irradiation of the far infrared rays I from the heating vessel 30, whereby water contained in the first precursor 11 is evaporated. Then, a part of the water evaporated from the first precursor 11 will permeate the water-permeable membrane 42 to be released to the outside. Another part of this water evaporated from the first precursor 11 will permeate the water-permeable membrane 41 and then permeate the heating vessel 30 formed of porous ceramics to be released to the outside.

At the IR irradiating step, the first precursor 11 may be vertically inverted by a predetermined time interval inside the heating vessel 30. In the instant embodiment, there will be described an exemplary case in which the first precursor 11 is inverted after 5 minutes heating and after another 5 minutes heating, the second precursor 12 is obtained. The second precursor 12, unlike the first precursor 11, will be molded into a plate-like shape (disc shape) having a certain degree of rigidity.

Figure 6:
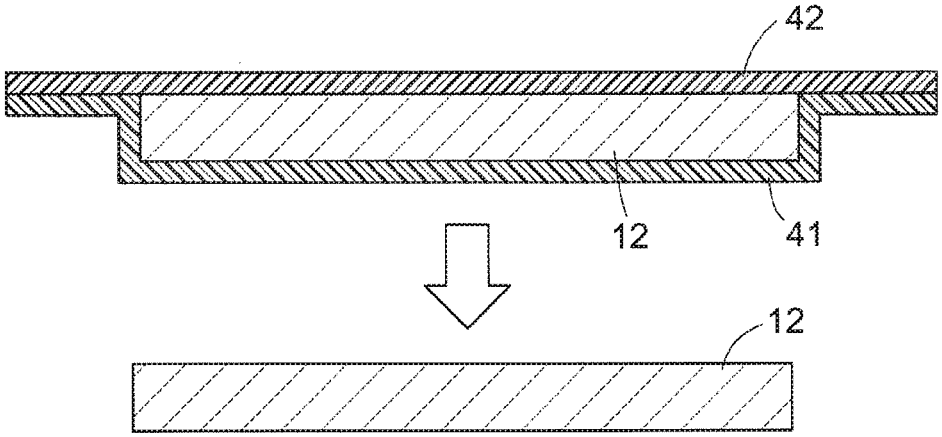
FIG. 6 is an explanatory view of a removing step.

After completion of the irradiating step described above, as shown in FIG. 6, the second precursor 12, together with the water-permeable membranes 41, 42, will be removed from the heating vessel 30 and then the water-permeable membranes 41, 42 will be removed from (or peeled off) the second precursor 12, whereby the second precursor 12 will be isolated (removing step).

[Molding Step]

Figure 7:
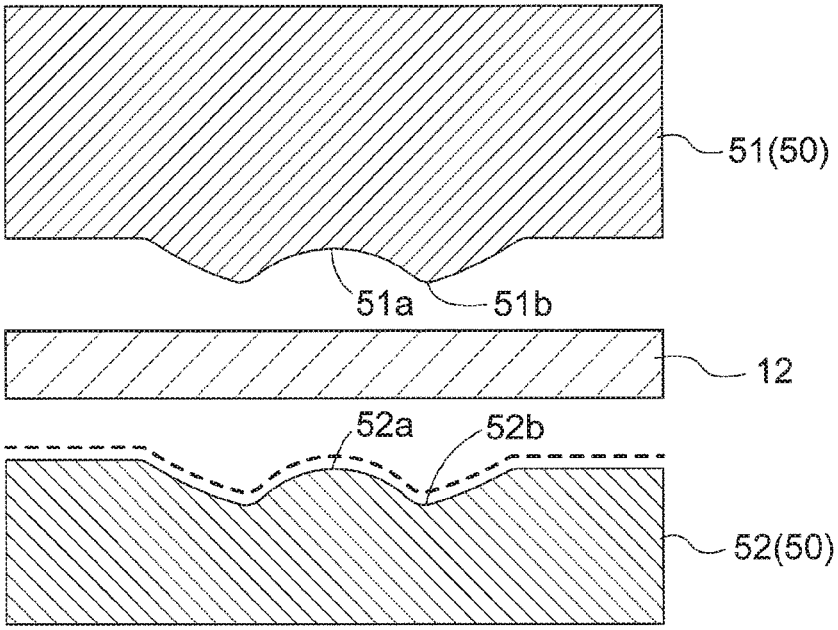
FIG. 7 is a schematic section for explaining molding by a mold at a molding step.
Figure 8:
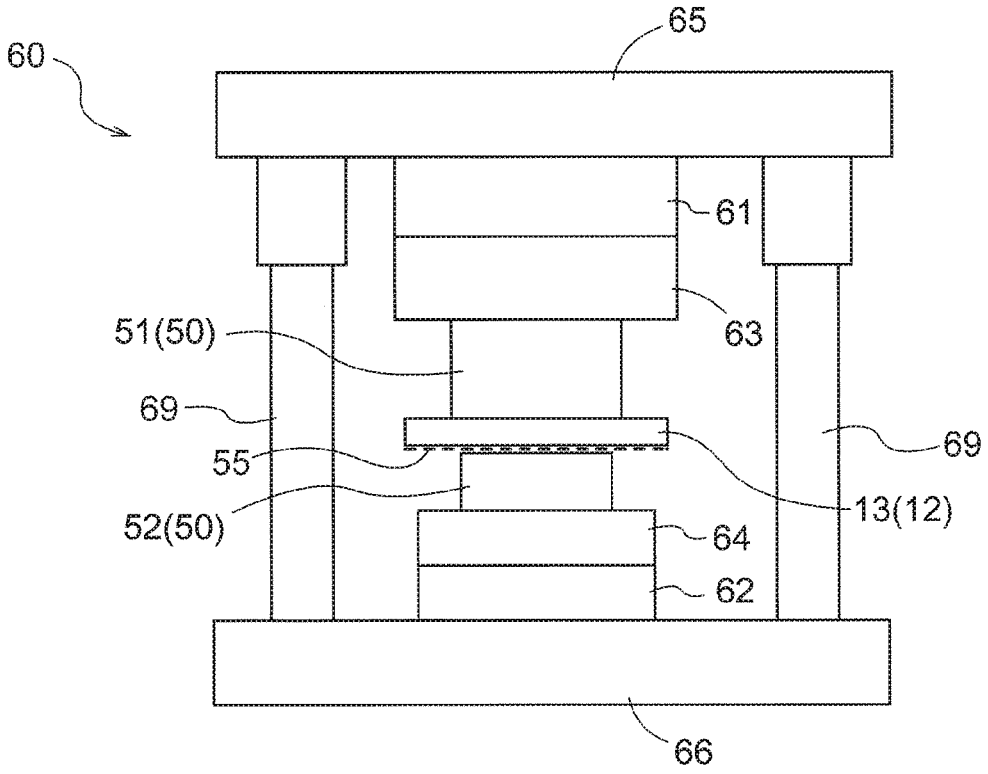
FIG. 8 is a schematic for explaining a compression state of the mold by a press machine at the molding step.

At the molding step, as shown in FIG. 7, the second precursor 12 is clamped by a mold 50 and then, as shown in FIG. 8, the second precursor 12 will be heated while being compressed (pressing) by a press machine 60, whereby a compact 13 is obtained.

The mold 50, as shown in FIG. 7, includes a pair of upper mold 51 (an example of a "first mold") and a lower mold 52 (an example of a "second mold"). In operation of the mold 50, as the second precursor 12 is clamped between the upper mold 51 and the lower mold 52 and pressed by the press machine 60, the second precursor 12 is deformed to be molded.

The pressure applied between the upper mold 51 and the lower mold 52 at the time of compression by the press machine 60 (this will be referred to as a "press pressure"

hereinafter) will be set to a pressure from 1 MPa to 20 MPa, for example. This press pressure is typically from 3 MPa to 8 MPa. By increasing/decreasing the press pressure within an appropriate range (from 1 MPa to 20 MPa), it is possible to increase/decrease the density of the compact 13 to be obtained. For instance, if it is desired to increase the density of the compact 13, the press pressure will be increased. Conversely, if it is desired to decrease the density of the compact 13, the press pressure will be decreased.

In the upper mold 51, for instance, in its lower face, there are formed a recess portion 51*a* and a protruding portion 51*b* annularly surrounding the recess portion 51*a*. Further, in the lower mold 52, in its upper face, there are formed a protruding portion 52*a* to be fitted into the recess portion 51*a* and a recess portion 52*b* into which the protruding portion 51*b* will be fitted. The upper face of the lower mold 52 (the surface which comes into contact with the second precursor 12) is covered by a metal mesh 55 (an example of a "mesh-like member") formed to follow this upper face. Thus, the second precursor 12 will be molded into a shape that follows or complies with the shapes of the recess portion 51*a* and the protruding portion 51*b* of the upper mold 51 and the shapes of the protruding portion 52*a* and the recess portion 52*b* of the lower mold 52, thus being formed into the compact 13.

In the course of the molding of the second precursor 12, the mold 50 will mold the second precursor 12 with heating this second precursor 12 by the heat supplied from the press machine 60. By effecting such heating in the course of molding of the second precursor 12, it is possible to allow sufficient drying of this second precursor 12, so that molding failure such as break of the second precursor 12 can be prevented and also the strength (in particular tensile elasticity modulus) of the compact 13 can be increased.

The temperature used at the time of molding by the mold 50 is set to from 100° C. to 150° C., for instance. By increasing/decreasing the temperature at the time of molding by the mold 50 within an appropriate range (e.g. the range from 100° C. to 150° C.), adjustment is made possible to increase/decrease the tensile elasticity modulus or the bending elasticity modulus of the compact 13. If it is desired to increase the tensile elasticity modulus of the compact 13, the temperature at the time of molding by the mold 50 will be set to a higher temperature. Conversely, if it is desired to decrease the tensile elasticity modulus of the compact 13, the temperature at the time of molding by the mold 50 will be set to a lower temperature.

At the time of molding of the second precursor 12, the temperature of the upper mold 51 and the temperature of the lower mold 52 of the mold 50 may be set same as each other or may be set different from each other. Further alternatively, the temperature of the mold 50 may be changed in the course of molding.

The metal mesh 55 is a mesh-like member formed with thin metal wires interwoven for instance. This metal mesh 55 may be a metal mesh woven by a certain standard weaving technique such as the plain weave or twill, etc. and a metal mesh from 100 mesh to 200 mesh number can be employed. Incidentally, the standard of the metal mesh 55 is explained herein based on JIS G 3555.

The metal mesh 55 is used as a "slip stopper" for the second precursor 12 relative to the lower mold 52. As this metal mesh 55 is interposed between the lower mold 52 and the second precursor 12, thanks to the frictional forces between the respective portions of the second precursor 12 and the metal mesh 55, break which can occur at the time of deformation of the second precursor 12 by the binding thereof between the upper mold 51 and the lower mold 52 (this will be referred to simply as "break phenomenon" hereinafter) is prevented. Incidentally, such break phenomenon occurs due to occurrence of local deformation or displacement (distortion) at a part of the second precursor 12, in association with the binding thereof by the upper mold 51 and the lower mold 52.

The press machine 60 is a device that compresses or presses the metal mesh 50. This press machine 60 includes a deck portion 66 on which the metal mesh 50, etc. is to be placed, a top plate 65 configured to bind the metal mesh 50 etc. with the deck portion 66, and pillar portions 69 incorporating hydraulic cylinders (not shown) for moving the top late 65 closer to or away from the deck portion 66. The press machine 60 is used in combination with spacers 61, 62 used at the time of pressing of the metal mesh 50 and heater blocks 63, 64 having heating elements such as sheath heaters, or the like. In the following, when it is referred to simply as the "press machine 60", this is understood to include such spacers 61, 62 and the heater blocks 63, 64.

The temperatures of the heater blocks 63, 64 will be kept at predetermined temperatures by means of e.g. unillustrated temperature controller, or the like. Further, the pressing force applied to the top plate 65 by the pillar portions 69, i.e. the press pressure, will also be kept at a predetermined value by means of an unillustrated regulator.

FIG. 8 illustrates a situation in which the mold 50 clamping the second precursor 12 is being compressed by the press machine 60, while it is being heated by the heater blocks 63, 64. Specifically, the deck portion 66, the spacer 62, the heater block 64, the mold 50, the heater block 63, the spacer 61 and the top plate 65 are stuck one on another in this mentioned order; and under this condition, the top plate 65 is being pressed toward the deck portion 66 by means of the hydraulic cylinders of the pillar portions 69. Incidentally, the mold 50 is disposed between the heater block 64 and the heater block 63, with the second precursor 12 being bound between the upper mold 51 and the lower mold 52 thereof.

The molding conditions (the temperature and the press pressure of the mold 50) used in the press machine 60 will be appropriately varied in accordance with the desired shape and/or the physical properties, etc. of the compact 13. In this embodiment, for instance, the compressing of the mold 50 of the press machine 60 (the press molding of the second precursor 12) is effected in two separate steps, with conditions made different from each other. Next, one example of the instant embodiment will be explained.

At the first step (to be referred to as "first step" hereinafter), the temperature of the heater block 63 placed in contact with the upper mold 51 for enabling heat conduction therewith is set to 100° C., whereas the temperature of the heater block 64 placed in contact with the lower mold 52 for enabling heat conduction therewith is set to 150° C. The press pressure is progressively (e.g. proportionally) increased to a predetermined value (e.g. 8 MPa as the predetermined value).

Figure 9:
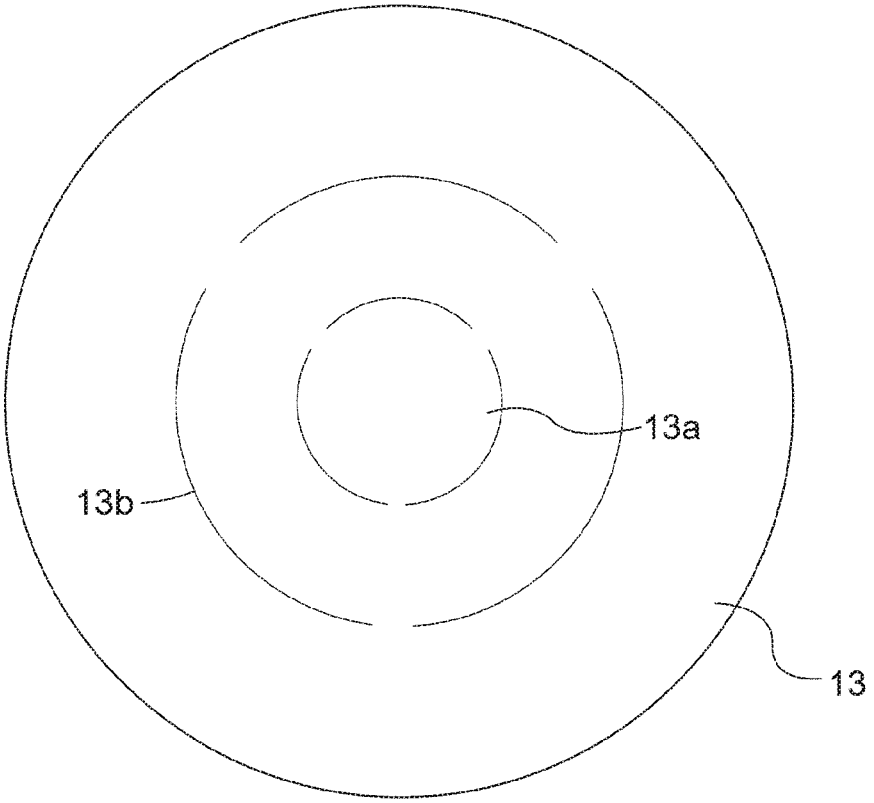
FIG. 9 is a plan view of a compact.
Figure 10:
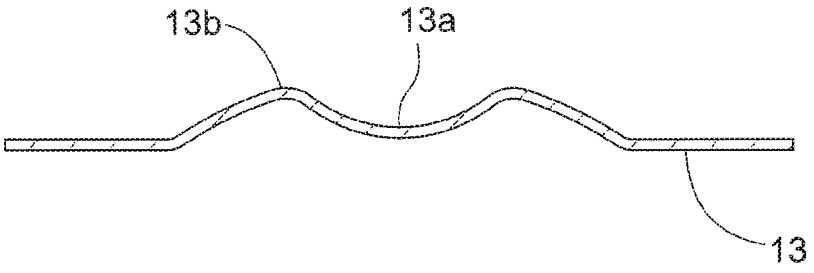
FIG. 10 is a schematic section for explaining a shape of the compact.

After completion of the first step, at the second step subsequent thereto (to be referred to simply as the "second step" hereinafter), the temperature of the heater block 63 is changed to 150° C. Whereas, the temperature of the heater block 64 and the press pressure are maintained same as those of the first step. When the temperature of the heater block 63 exceeds 140° C., upon lapse of 2 minutes thereafter, the second step is completed to obtain the compact 13. At the time of completion of the second step, the heating operations of the heater blocks 63, 64 are terminated and the press pressure of the top plate 65 is released. Thereafter, the mold 50 is removed from the press machine 60 and the compact 13 in the form of a thin plate molded to the desired shape will be collected (see FIG. 8 and FIG. 9).

In the compact 13, there are formed a first transferred portion 13*a* transferring the shapes of the recess portion 51*a* and the protruding portion 52*a* and a second transferred portion 13*b* transferring the shapes of the protruding portion 51*b* and the recess portion 52*b*, respectively. The compact 13 is molded into a desired shape as described above and moreover, the compact 13 will be formed as a cellulose thin plate (e.g. having a thickness of 200 μm) having a high strength ($1.0\times10^{10}$ Pa) unobtainable by the conventional technique.

This compact 13 can be used in an audio device such as a diaphragm of a speaker or other structure component. As the compact 13 has high internal loss, it can realize sound quality improvement for an audio component (especially, a speaker). One example of structure component other than a speaker diaphragm is a home electric appliance or a car-mounted product and is suitable especially as a structure component of a car mounted product from which weight reduction and strength are required.

As described above, the manufacturing method of a cellulose nanofiber compact can realize a cellulose nanofiber compact having high strength.

OTHER EMBODIMENTS (1) In the foregoing embodiment, there was disclosed a case in which the heating vessel 30 comprises a porous member. However, the porosity of the heating vessel 30 is not an essential requirement.

(2) In the foregoing embodiment, there was described an exemplary case in which the heating vessel 30 is formed of ceramics. However, the material forming the heating vessel 30 is not limited to ceramics, but the material to form the heating vessel 30 may be any that can radiate large amount of infrared rays (in particular, far infrared rays). For instance, the heating vessel 30 may be formed of carbon.

(3) In the foregoing embodiment, there was described an exemplary case in which the far infrared rays I are radiated from the heating vessel 30 and these far infrared rays I are irradiated onto the first precursor 11. However, sole requirement here is irradiation of the first precursor 11 with far infrared rays, thus, the arrangement is not limited to the arrangement of irradiation of the far infrared rays I radiated from the heating vessel 30. For instance, a radiation source of far infrared rays such as a carbon heater may be provided separately and far infrared rays radiated from this radiation source may be irradiated onto the first precursor 11 supported to the heating vessel 30 to have its shape held thereby.

(4) In the foregoing embodiment, there was described an exemplary case in which at the condensing step, the water-permeable membrane 41 is placed to cover the bottom plate 22 and on this water-permeable membrane 41, the slurry 10 is spread over and with the irradiation of the microwave W, this slurry 10 is heated. However, the water-permeable membrane 41 is not an essential requirement.

(5) In the foregoing embodiment, there was described the exemplary case in which with the surface of the slurry 10 being covered by the lid member 25, the microwave W is irradiated onto the slurry 10 for heating it. However, the lid member 25 is not an essential requirement.

(6) In the foregoing embodiment, there was described an exemplary case in which the upper face of the lower mold 52 is covered with the metal mesh 55. However, the function of the metal mesh 55 is not limited to covering of the upper face of the lower mold 52. It may cover the lower face of the upper mold 51. In this case, the metal mesh 55 will serve to prevent slippage of the second precursor 12 relative to the upper mold 51, so that the break phenomenon can be prevented.

(7) In the foregoing embodiment, there was described an exemplary case in which the upper face of the lower mold 52 is covered with the metal mesh 55. However, in place of covering the upper face of the lower mold 52 with the metal mesh 55, unevenness (e.g. many protrusions or mesh-like grooves) may be provided in the upper face of the lower mold 52. Further, in addition to the lower mold 52 or instead of the lower mold 52, such unevenness may be provided in the lower face of the upper mold 51. In this case, the unevenness will function as the anti-slippage means for the second precursor 12 relative to the upper mold 51 or the lower mold 52, so that the break phenomenon can be prevented.

(8) In the foregoing embodiment, there was described an exemplary case in which a predetermined measured amount of the slurry 10 is charged into the condensing vessel 20 (onto the water-permeable membrane 41) and after this slurry 41 is spread over the water-permeable membrane 41, the surface of this slurry 10 is covered by the lid member 25. In this embodiment, before the surface of the slurry 10 is covered with the lid member 25, the slurry 10 may be defoamed. Defoaming of the slurry 10 is possible by charging the entire condensing vessel 20 into a depressurizing vessel or a centrifugal separator, etc.

(9) In the foregoing embodiment, there was described an exemplary case in which the compact 13 is formed from the slurry 10 which is a water dispersion containing 3 mass % of CNF. However, the slurry 10 can contain other "additive" in addition to CNF. With this, there can be obtained a compact 13 provided with a functionality afforded by such additive.

As examples of such additive, there can be cited micro hollow glass spheres (so-called glass bubbles), cellulose spherical bodies, carbon nanotubes. With addition of the micro hollow glass spheres or cellulose spherical bodies, weight reduction of the compact 13 can be achieved. With addition of carbon nanotubes, further additional strength of the compact 13 as well as provision of electric conductivity thereto can be realized.

Incidentally, the arrangements disclosed in the foregoing embodiment (including the further embodiments) can be used in combination with the arrangement(s) disclosed in the other embodiment(s) as long as no contradiction results from such combination. Also, the embodiments disclosed in this detailed disclosure are only illustrative, and embodiments of the present invention are not limited the disclosed embodiments, but may be modified within a range not deviating from the object of the present invention.

The invention claimed is:

1. A method of manufacturing a cellulose nanofiber compact, the method comprising the following steps in the following order:

condensing a cellulose nanofiber containing slurry containing cellulose nanofibers in an amount equal to or greater than 0.5 mass % and less than less than 10 mass % by microwave heating to obtain a plate-like first precursor having a mass equal to or greater than 45% and equal to or less than 55% relative to a mass of the slurry, the cellulose nanofiber having a fiber diameter equal to or greater than 1 nm and equal to or less than 150 nm and a fiber length equal to or greater than 3 nm and less than 300 μm, wherein by condensing the cellulose nanofiber-containing slurry by microwave heating in the condensing step, the entire slurry within a condensing vessel can be heated, the drying rate can be increased without causing excessive local drying and the period required for condensing can be shortened, and thus reduction in the strength of the first precursor can be suppressed;

supporting the first precursor placed on a bottom portion in a heating vessel formed of porous ceramics defining therein many pores that allow passage of water vapor;

infrared heating the first precursor supported in the heating vessel with infrared rays for a period of equal to or longer than 5 minutes and equal to or shorter than 15 minutes and keeping a temperature of the first precursor at equal to or higher than 45° C. and equal to or lower than 115° C. to obtain a plate-like second precursor having a water content less than a water content of the first precursor, wherein as the infrared rays are irradiated on the first precursor obtained in the condensing step, the molecules of CNF are applied with energy in the infrared range so that vibration of chemical bonds including the hydroxy group occurs, side chains of the CNF molecules come closer to each other thus promoting hydrogen bonding among the CNF molecules, the second precursor can be obtained with the hydrogen bonds promoted, and strength of the compact including tensile modulus of elasticity or bending modulus of elasticity is improved; and molding the second precursor, with heating the second precursor and pressurizing the second precursor at a pressure equal to or higher than 1 MPa and equal to or lower than 20 MPa in a mold having a temperature equal to or higher than 100° C. and equal to or lower than 150° C.

2. The cellulose nanofiber compact manufacturing method of claim 1, wherein:

at the heating step, the first precursor is heated by infrared rays radiated from the heating vessel.

3. The cellulose nanofiber compact manufacturing method of claim 1, wherein:

at the heating step, water contained in the first precursor is released through pores of the heating vessel to the outside.

4. The cellulose nanofiber compact manufacturing method of claim 2, wherein:

at the heating step, water contained in the first precursor is released through pores of the heating vessel to the outside.

5. The cellulose nanofiber compact manufacturing method of claim 1, wherein at the supporting step, the first precursor is supported with cellophane being interposed between the first precursor and the heating vessel.

6. The cellulose nanofiber compact manufacturing method of claim 2, wherein at the supporting step, the first precursor is supported with cellophane being interposed between the first precursor and the heating vessel.

7. The cellulose nanofiber compact manufacturing method of claim 3, wherein at the supporting step, the first precursor is supported with cellophane being interposed between the first precursor and the heating vessel.

8. The cellulose nanofiber compact manufacturing method of claim 4, wherein at the supporting step, the first precursor is supported with cellophane being interposed between the first precursor and the heating vessel.

9. The cellulose nanofiber compact manufacturing method of claim 1, wherein:

the mold includes a first mold and a second mold disposed in opposition to the first mold;

the second precursor is mounted and pressurized between the first mold and the second mold; and a surface of the second mold in contact with the second precursor is covered by a mesh-like member.

10. The cellulose nanofiber compact manufacturing method of claim 2, wherein:

the mold includes a first mold and a second mold disposed in opposition to the first mold;

the second precursor is mounted and pressurized between the first mold and the second mold; and a surface of the second mold in contact with the second precursor is covered by a mesh-like member.

11. The cellulose nanofiber compact manufacturing method of claim 3, wherein:

the mold includes a first mold and a second mold disposed in opposition to the first mold;

the second precursor is mounted and pressurized between the first mold and the second mold; and a surface of the second mold in contact with the second precursor is covered by a mesh-like member.

12. The cellulose nanofiber compact manufacturing method of claim 4, wherein:

the mold includes a first mold and a second mold disposed in opposition to the first mold;

the second precursor is mounted and pressurized between the first mold and the second mold; and a surface of the second mold in contact with the second precursor is covered by a mesh-like member.

13. The cellulose nanofiber compact manufacturing method of claim 5, wherein:

the mold includes a first mold and a second mold disposed in opposition to the first mold;

the second precursor is mounted and pressurized between the first mold and the second mold; and a surface of the second mold in contact with the second precursor is covered by a mesh-like member.

14. The cellulose nanofiber compact manufacturing method of claim 6, wherein:

the mold includes a first mold and a second mold disposed in opposition to the first mold;

the second precursor is mounted and pressurized between the first mold and the second mold; and a surface of the second mold in contact with the second precursor is covered by a mesh-like member.

15. The cellulose nanofiber compact manufacturing method of claim 7, wherein:

the mold includes a first mold and a second mold disposed in opposition to the first mold;

the second precursor is mounted and pressurized between the first mold and the second mold; and a surface of the second mold in contact with the second precursor is covered by a mesh-like member.

16. The cellulose nanofiber compact manufacturing method of claim 8, wherein:

the mold includes a first mold and a second mold disposed in opposition to the first mold;

the second precursor is mounted and pressurized between the first mold and the second mold; and a surface of the second mold in contact with the second precursor is covered by a mesh-like member.

17. The cellulose nanofiber compact manufacturing method of claim 1, wherein:

the condensing step includes charging the cellulose nanofiber containing slurry into a bottomed cylindrical condensing vessel and covering a center portion of the surface of the cellulose nanofiber containing slurry within the condensing vessel with a lid member.

18. The cellulose nanofiber compact manufacturing method of claim 2, wherein:

the condensing step includes a charging step of charging the cellulose nanofiber containing slurry into a bottomed cylindrical condensing vessel and covering a center portion of the surface of the cellulose nanofiber containing slurry within the condensing vessel with a lid member.

19. The cellulose nanofiber compact manufacturing method of claim 1, wherein:

the preliminary molding step includes an aging step of promoting the hydrogen bond between the nanocellulose fibers in the second precursor, with keeping the surface temperature of the heating vessel between equal to or higher than 50° C. and equal to or lower than 120° C.

20. The cellulose nanofiber compact manufacturing method of claim 2, wherein:

the preliminary molding step includes an aging step of promoting the hydrogen bond between the nanocellulose fibers in the second precursor, with keeping the surface temperature of the heating vessel between equal to or higher than 50° C. and equal to or lower than 120° C.

* * * * *